United States Patent [19]

Bowman

[11] Patent Number: 4,901,965

[45] Date of Patent: Feb. 20, 1990

[54] CONTINUOUS HEIGHT ADJUSTMENT WALL STANDARD AND ANCHOR ASSEMBLY

[76] Inventor: Thomas C. Bowman, 410 Glen Oak Dr., N.W., Grand Rapids, Mich. 49504

[21] Appl. No.: 312,200

[22] Filed: Feb. 21, 1989

[51] Int. Cl.[4] ..... A47G 29/02

[52] U.S. Cl. ..... 248/246; 108/108; 248/297.2

[58] Field of Search ..... 248/246, 245, 297.2, 248/297.3, 125, 295.1; 108/108; 211/192, 187, 193, 207, 103; 182/92, 100

[56] References Cited

U.S. PATENT DOCUMENTS

| | | | |
|---|---|---|---|
| 2,727,711 | 12/1955 | Bally | 248/246 |
| 3,291,319 | 12/1966 | Novales | 211/192 |
| 3,865,337 | 2/1975 | Towfigh | 248/246 |
| 4,754,841 | 7/1988 | Koffski | 182/92 |

FOREIGN PATENT DOCUMENTS

| | | | |
|---|---|---|---|
| 2737973 | 9/1978 | Fed. Rep. of Germany | 248/246 |
| 2685 | of 1912 | United Kingdom | 248/246 |
| 1523264 | 8/1978 | United Kingdom | 248/245 |

*Primary Examiner*—J. Franklin Foss

*Attorney, Agent, or Firm*—Varnum, Riddering, Schmidt & Howlett

[57] ABSTRACT

A support assembly in which a standard and a support bracket are provided with interengaging components for securing the support bracket in a selected vertical position relative to the standard. The standard has two opposed, spaced surfaces between which are received a pair of locking tabs projecting from one side of the support bracket. Each locking tab is generally rectangular in cross section and is angled to present a sharp horizontally extending corner. When these locking tabs are positioned between the faces of the standard, and the free end of the support bracket is tilted downwardly, the upper latching tab moves toward and bites into a pair of ribs projecting from one of the opposed surfaces while the lower latching tab moves in the opposite direction to bite into a pair of projecting ribs from the opposite surface. When this occurs, the support bracket is fixed relative to the standard. The locking relationship permits the support bracket to be continuously vertically adjustable relative to the standard.

15 Claims, 3 Drawing Sheets

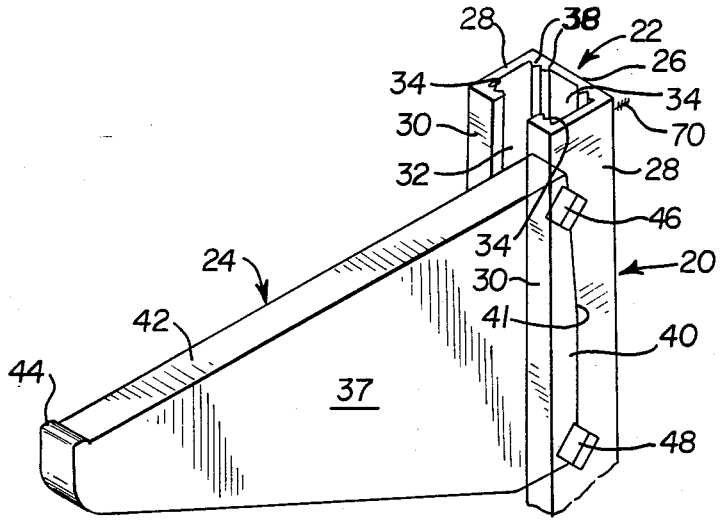
FIG. 1
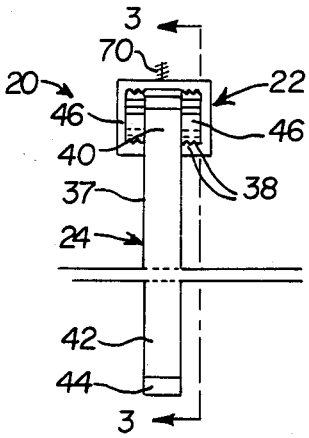
FIG. 2
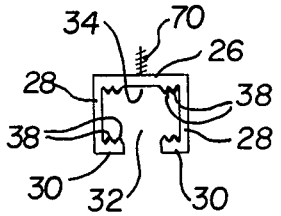
FIG. 5
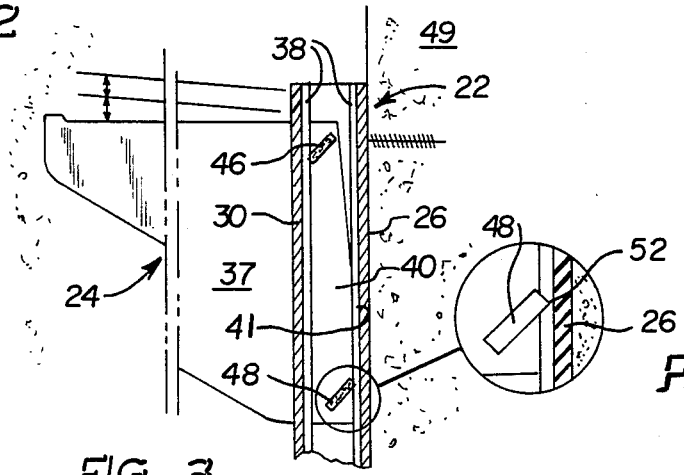
FIG. 3
FIG. 4

CONTINUOUS HEIGHT ADJUSTMENT WALL STANDARD AND ANCHOR ASSEMBLY

This invention relates in general to new and useful improvements in support assemblies of the type in which a standard may be secured to a wall or otherwise maintained in an upright position, and a support bracket is interlockingly engageable with the standard at a selected variable height.

It is well known in assemblies of this general type that the standard is provided with a series of vertically spaced slots and the support bracket is provided with one or more fingers for reception within such slots to interlock with the standard. It is also well known in such assemblies to provide the standard and the bracket with saw-tooth interlocking configurations. U.S. Pat. No. 565,539 to Hartzell and 1,066,806 to Freud are typical of such prior construction.

There are also assemblies of this type in which the support bracket is clamped in a selected position by means of a threaded clamp member, as is taught by Freud in U.S. Pat. No. 1,041,264.

A much more complicated wedging support arrangement between a support bracket and a standard is taught in U.S. Pat. No. 501,591 to Richards.

Other adjustable support assemblies are known from U.S. Pat. Nos. 2,703,692 to Felix, 3,429,540 to Worrallo, 3,664,627 to Sykes et al, 3.975.338 to Towfigh et al, 4,170,335 to King, and 4,538,784 to O'Flanagan.

The present invention relates to an assembly in which the supporting standard is provided with oppositely facing surfaces and the support bracket is provided with locking tabs of which at least one is adapted to engage one of the opposed surfaces in a manner to retain the support bracket at any adjusted height relative to the standard.

More particularly, at least one, and preferably each, of the opposing surfaces is provided with one or more vertically extending ribs, the ribs of the opposing surfaces facing one another and being generally ridged or pointed. Preferably, each locking tab is provided with a sharp corner which is generally horizontal so as to bite into a rib when the support bracket is tilted to its locked position relative to the standard.

Further, since it is necessary to tilt the support standard upwardly from a generally horizontal position to disengage the support bracket and the standard and adjust the height of the bracket, there may be provided a locking structure which is positionable to prevent such upward tilting movement.

The cross-sectional configuration of the standard may vary and may include two sets of such opposed surfaces whereby the bracket will be provided with two corresponding sets of locking tabs.

With the above and other features in view, as will hereinafter appear, the nature of the invention will be more clearly understood by reference to the following detailed description, the appended claims, and the several views illustrated in the accompanying drawings, in which:

FIG. 1 is a perspective view from above and one side of a standard and support bracket assembly formed in accordance with this invention, the standard being shown in fragmentary form and in phantom outline to reveal features of the bracket;

FIG. 2 is a top plan view of the assembly of FIG. 1 which shows more clearly the details of the lock between the support bracket and the standard;

FIG. 3 is a fragmentary vertical sectional view taken generally along the line 3—3 of FIG. 2 and shows specifically the details of the interlock between the support bracket locking tabs and the faces of the standard;

FIG. 4 is an enlargement of the circled portion of FIG. 3 showing specifically the biting relationship between a locking tab and a rib of an opposed surface of the standard;

FIG. 5 is a top plan view of a typical standard showing the specific configuration thereof;

Figure 6:
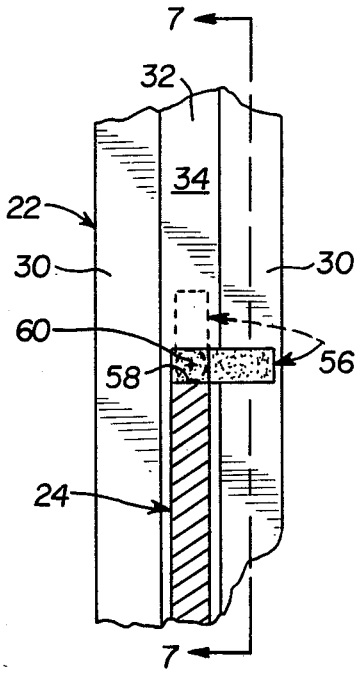
FIG. 6 is a fragmentary front elevational view of an assembly similar to that of FIG. 1 but in which an optional locking device has been provided, the locking device being shown in interrupted lines in its inoperative position.

Referring now to the drawings in detail, there is illustrated in FIG. 1 a support assembly constructed in accordance with this invention, the assembly being generally identified by the numeral 20 and including an elongate upright standard, shown in phantom outline and generally identified by the numeral 22, and a support bracket, generally identified by the numeral 24.

The standard 22 is of channel configuration and includes a rear web 26, two lateral flanges 28, and inturned front flanges 30 which stop short of one another to define a front vertical slot or gap 32. The web 26 and the front flanges 30 provide spaced surfaces 34 arranged in pairs. Each of the surfaces 34 preferably includes facing ribs 38 which extend longitudinally of the standard 22 and are pointed in cross section.

The support bracket 24 preferably takes the form of a sheet or plate member 37 of a thickness substantially equal to, but slightly less than the width of the gap 32. A base portion 40 of the plate member 37 is receivable between the front flanges 30 and terminates in an angled edge 41. An upper support surface 42 of the member 38 terminates in an upstanding nose 44 in conventional manner.

In order that the support bracket 24 will securely interlock with the standard 22, it is provided on at least one side of its base portion 40 with projecting upper and lower locking tabs 46, 48 generally aligned with and disposed between the surfaces 34, as is best shown in FIGS. 2 and 3.

With particular reference to FIG. 3, which shows the assembly 20 supported on a wall 49, it will be noted that each of the locking tabs 46, 48 is preferably of rectangular cross section and slopes upwardly and rearwardly. Further, it will be seen that the total horizontal dimension of each of the locking tabs 46, 48 is less than the spacing between the ribs 38. Thus when the support bracket 24 is to be interlocked with the standard 22, the base portion 40 thereof including the locking tabs 46, 48 is inserted into the standard at its upper or lower end and then moved to the desired height with the upper support surface 42 at an angle above the horizontal, an attitude facilitated by the angled edge 41. The support bracket 24 is then tilted downwardly so that the upper support surface 42 is approximately horizontal, whereby locking tab 46 engages the corresponding rib 38 carried by the respective front flange 30 while the locking tab 48 engages the corresponding rib 38 carried by the web 26.

More particularly, as is best illustrated in the enlarged view of FIG. 4, the locking tabs 46, 48, being of rectangular configuration, are respectively provided with a horizontally oriented lower corner 50 (FIG. 7) and a horizontally extending upper corner 52, each corner 50, 52 forming a sharp edge. Referring again to FIG. 4, the corner 52 engages and bites into the respective rib 38 carried by the web 26. Similar biting engagement with the respective rib 38 carried by one of the front flanges 30 is effected by the corner 50 of the upper locking tab 46. Because of this biting action, the support bracket 24 is locked against vertical sliding movement relative to the standard 22. Thus may one position the locking tabs 46, 48 vertically in any position corresponding to the height desired for the support bracket 24.

To move the bracket 24 to another height relative to the standard 22, the bracket is tilted upwardly, a movement facilitated by the angled edge 41, to disengage the locking tabs 46, 48 from the respective ribs 38. The bracket is then raised or lowered to the new height and tilted downwardly again to lock it there as described hereinabove.

Generally speaking the standard 22 will be extruded of a metal such as aluminum which is softer than the locking tabs 46, 48, preferably formed of steel, to facilitate the biting effect.

Figure 7:
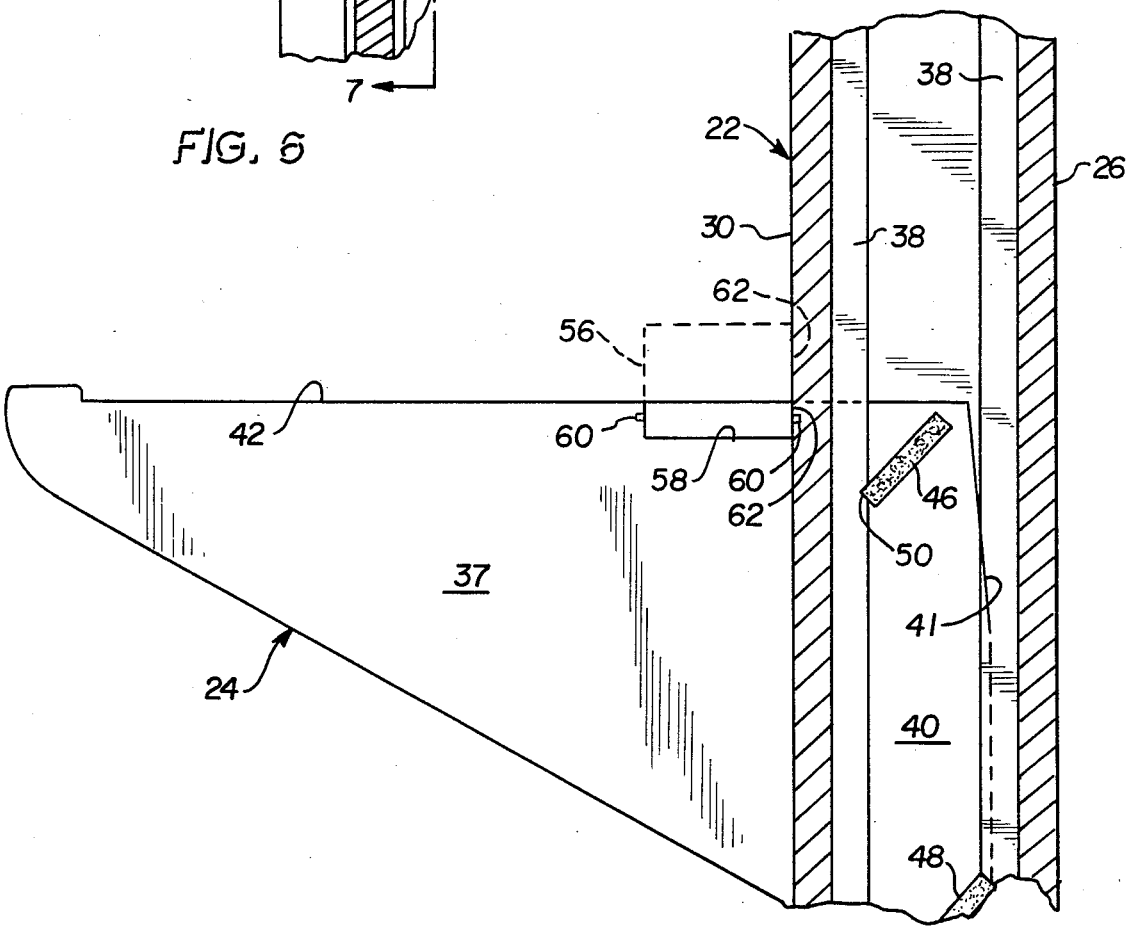
FIG. 7 is a fragmentary vertical sectional view taken generally along the line 7—7 of FIG. 6 and shows further the relationship of the locking device with the associated standard.

It will be apparent from FIGS. 1 and 3 that the locking tabs 46, 48 will be securely locked in place by the effect of weight imposed upon the support bracket 24, although it will be initially held in place when it is locked by virtue of its own weight and the biting engagement of the locking tabs and the ribs. However, the support bracket may be displaced from locking engagement with the standard if it is inadvertently tilted upwardly at its outer end. As shown in FIGS. 6 and 7, this may be avoided and the support bracket 24 securely retained in its locked position relative to the standard 22 by means of a locking device generally identified by the numeral 56. In such an embodiment the support surface 42 of the bracket 24 is formed with a notch 58 adjacent to the front flange 30 of the standard 22. One end of the locking device 56 is seated in the notch 58 and the locking device 56 is connected to the support bracket 24 by a pair of aligned pins 60.

Initially the locking device 56 will be in an upstanding position as shown in interrupted lines in both FIGS. 6 and 7 so that it may enter into the gap 32 when the bracket is tilted upwardly for height adjustment. Then, when the bracket 24 has been tilted downwardly to its locking position, a rear edge 62 of the locking device 56 may be pivoted 90 degrees from alignment with the gap 32 so that its rear edge 62 will engage the front flange 30, as is shown in solid lines in FIGS. 6 and 7. Now the upper locking tab 46 will be retained in its biting engagement with the respective ribs 38 and the support bracket 24 cannot be accidentally released from locking relationship with the standard 22.

Figure 8:
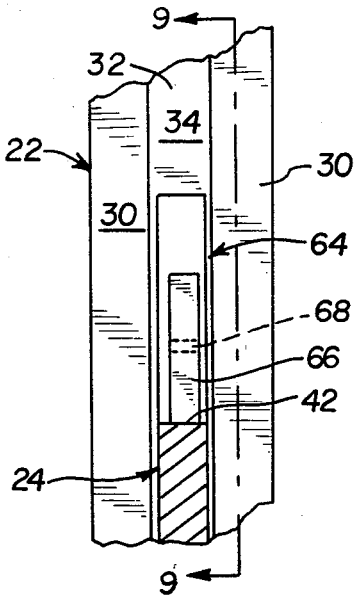
FIG. 8 is another fragmentary front elevational view of a modified form of assembly in which the support bracket carries an alternative type of locking device engageable with the standard.
Figure 9:
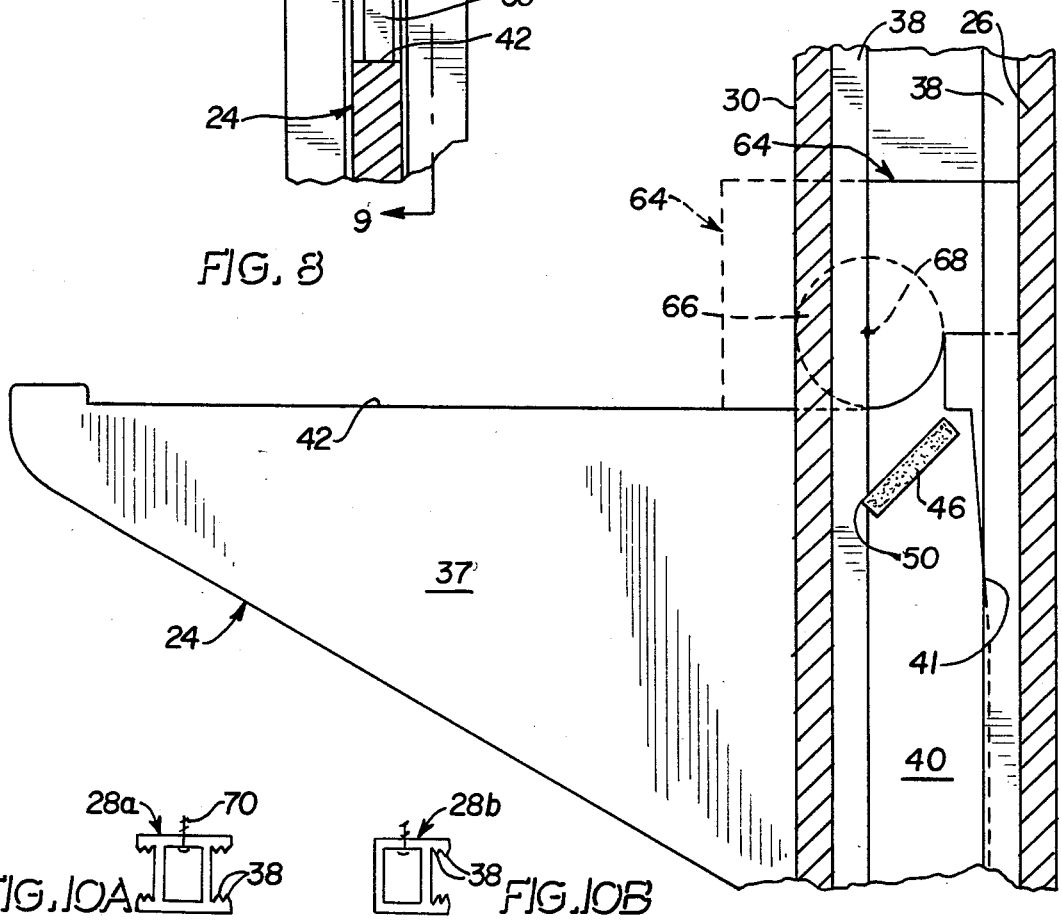
FIG. 9 is a fragmentary vertical sectional view taken generally along the line 9—9 of FIG. 8 and shows more specifically the configuration of the locking device and its relationship to the standard, the locking device being shown in inoperative position in interrupted lines.
Figure 10A:
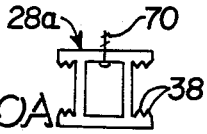
FIGS. 10A to 10F are top plan views of alternative configurations of the standard.
Figure 10B:
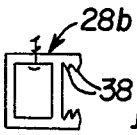
Figure 10C:
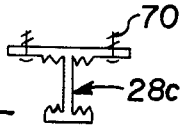
Figure 10D:
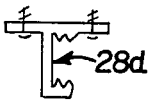
Figure 10E:
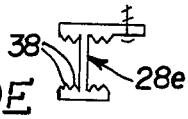
Figure 10F:
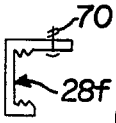

Reference is now made to FIGS. 8 and 9 in which an alternative form of locking device 64 is shown. This locking device is of generally L-shaped configuration and has a pivotal connection 68 with an upstanding projection 66 on the support bracket 24. Normally, the locking device 64 is seated on the top surface of the support bracket 24, as shown in FIG. 9 in interrupted lines, and is in position for entering into the gap 32. However, once the support bracket 24 has been locked with the standard 22, the locking device 64 may be rotated from the upstanding position shown in interrupted lines in FIG. 9 to its horizontal position, shown in solid lines in the same figure, so as to bear against the forward face of the web 26 between the ribs 38 carried by the web. This results in the locking of the support bracket 24 in the position illustrated in FIG. 9 so that the latching tab 46 cannot be moved rearwardly out of locking engagement with the associated rib 38 carried by the front flange 30.

While the transverse configuration of the standard 22 illustrated in FIG. 5 is preferred, it is to be understood that the standard may be of other configurations or cross sections, such as are represented by the standards **28*a* to 28*f* illustrated in FIGS. 10A to 10F, respectively. In each instance, however, the standard will be provided with two opposed surfaces, each of which is provided with at least one ridged pointed rib, two being shown in FIGS. 10A to 10F**.

Should the standard be provided with only one pair of opposed ribs 38, then the standard support bracket 24 associated therewith need have only one set of locking tabs 46, 48.

It is further to be understood that the standard will normally be secured to a vertical support, such as a wall, by means of fasteners such as screws 70 which extend through the web 26 of the respective standard at suitable vertical intervals; though other means of supporting the standard in a vertically extending or erect attitude will readily occur to skilled persons. Though roundhead screws 70 are shown in FIGS. 10A to 10F, countersunk screws are preferable when the locking device 64 of FIG. 9 is provided.

Although only preferred embodiments of the invention have been specifically illustrated and described herein, it is to be understood that variations may be made in the standard or in the support bracket without departing from the spirit and scope of the invention as defined in the appended claims.

What is claimed is:

1. A continuously adjustable support assembly comprising a standard and a support bracket, the standard having a pair of parallel opposed surfaces extending longitudinally thereof, at least one of the surfaces including longitudinally extending rib means, the support bracket being adapted to extend outwardly from the standard and having a rear mounting portion, and a pair of vertically spaced locking tabs projecting laterally from one side of the mounting portion, the locking tabs being adapted to be received between the opposed surfaces of the standard, the locking tabs being disposed to respectively engage the opposed surfaces, at least one of the locking tabs having an edge portion disposed for interlocking engagement with the rib means to retain the support bracket at a preselected height relative to the standard.

2. A support assembly according to claim 1, wherein said one of the locking tabs is formed with a sharp corner defining the edge portion, whereby the edge portion is adapted to bite into the rib means.

3. A support assembly according to claim 2, wherein the corner and the edge portion defined thereby extend generally transversely of the rib means.

4. A support assembly according to claim 1, wherein the rib means comprises at least one rib projecting from said one surface toward said one locking tab.

5. A support assembly according to claim 4, wherein said rib is generally pointed in opposition to said one locking tab.

6. A support assembly according to claim 1, wherein the rib means comprises at least one rib projecting from each of said opposed surfaces, said ribs being in opposed spaced relation.

7. A support assembly according to claim 6, wherein each of said locking tabs is positioned for interlocking engagement with a respective one of said opposed ribs.

8. A support assembly according to claim 6, wherein each of said locking tabs if formed with a sharp corner defining said edge portion and disposed for interlocking engagement with a respective one of said ribs.

9. A support assembly according to claim 1, wherein the horizontal dimension of each of said locking tabs is smaller than the distance between said opposed surfaces, whereby said bracket may be tilted downwardly relative to the standard to engage each of the locking tabs with a respective one of the surfaces.

10. A support assembly according to claim 7, wherein the horizontal dimension of each of said locking tabs is smaller than the distance between said opposed surfaces, whereby said bracket may be tilted downwardly relative to the standard to engage each of the locking tabs with a respective one of the surfaces.

11. A support assembly according to claim 2, wherein the rib means comprises a pair of parallel ribs, and said sharp corner is disposed to bite into both of said ribs.

12. A support assembly according to claim 1, including two sets of said opposed surfaces and two sets of said locking tabs, said sets of locking tabs respectively projecting laterally in opposite directions from the support bracket, one of said sets of locking tabs being associated with a respective one of said sets of surfaces.

13. A support assembly according to claim 9, including a pivotally mounted locking device carried by the support bracket for engaging the standard to prevent the support bracket from being tilted to a releasing position.

14. A support assembly according to claim 13, wherein the pivotal axis of the locking device extends parallel with the longitudinal axis of the support bracket.

15. A support assembly according to claim 13, wherein the pivotal axis of the locking device is disposed transversely of the support bracket.

* * * * *